US006333106B2

(12) United States Patent
Howell et al.

(10) Patent No.: US 6,333,106 B2
(45) **Date of Patent: *Dec. 25, 2001**

(54) DRAW TEXTURED POLY(TRIMETHYLENE TEREPHTHALATE) YARN

(75) Inventors: James M Howell; Joe F London, Jr., both of Greenville, NC (US); Michelle H Watkins, Waynesboro, VA (US)

(73) Assignee: E. I. Du Pont De Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/805,480

(22) Filed: Mar. 13, 2001

Related U.S. Application Data

(63) Continuation of application No. 09/518,732, filed on Mar. 3, 2000.

(51) Int. Cl.[7] ..... D01F 6/00; D01F 6/62
(52) U.S. Cl. ..... 428/364; 428/395
(58) Field of Search ..... 428/364, 395

(56) References Cited

U.S. PATENT DOCUMENTS

| | | | |
|---|---|---|---|
| 3,350,871 | 11/1967 | Pierce et al. | 57/140 |
| 3,584,103 | 6/1971 | Harris | 264/168 |
| 3,671,379 | 6/1972 | Evans et al. | 161/173 |

(List continued on next page.)

FOREIGN PATENT DOCUMENTS

| | | |
|---|---|---|
| 0 049 412 | 4/1985 | (EP) . |
| 0 745 711 A1 | 12/1996 | (EP) . |
| 1 016 741 A1 | 7/2000 | (EP) . |

(List continued on next page.)

OTHER PUBLICATIONS

H. L. Traub, "Synthese und textilchemische Eigenschaften des Poly–Trimethyleneterephthalats", *Dissertaion Universitat Stuttgart*, (1994) (English Translation).
Katsuhiko et al., "Elastic Moduli of Poly(trimethylene terephthalate) in the Crystalline Region", *Zairyo* (*Material*), 35, No. 396, 106–110, (1986).
W. Oppermann et al., Fibers Made of Poly(trimethylene terephthalate), Dornbirn, (1995).
H. L. Traub et al., "Mechanical Properties of Fibers Made of Polytrimethylene Terephthalate", *Chemical Fibers International* (*CFI*), 45, 110–111, (1995).
H. L. Traub, Dyeing Properties of Poly(Trimethylene Terephthalate) Fibres, *Melliand*, (1995).
Degussa Trade Literature (Estimated 1994).
U.S. Patent application No. 09/062,463, filed Apr. 17, 1998 (Docket#CH2635).
U.S. Patent application No. 09/273,288, filed Mar. 19, 1999 (Docket#CL1283).

(List continued on next page.)

*Primary Examiner*—N Edwards
(74) *Attorney, Agent, or Firm*—Nancy S. Mayer; Mark D. Kuller

(57) ABSTRACT

A stable partially oriented poly(trimethylene terephthalate) yarn suitable for use in subsequent drawing and/or draw-texturing operations characterized by an elongation to break of at least 110%, and a process for false-twist texturing a partially oriented poly(trimethylene terephthalate) yarn are disclosed.

19 Claims, 4 Drawing Sheets

U.S. PATENT DOCUMENTS

| | | | |
|---|---|---|---|
| 3,681,188 | 8/1972 | Harris | 161/173 |
| 3,816,486 | 6/1974 | Vail | 260/75 R |
| 3,984,600 | 10/1976 | Kawase et al. | 428/364 |
| 4,475,300 | 10/1984 | Kimura et al. | 428/364 |
| 4,475,330 | 10/1984 | Kimura et al. | 57/245 |
| 5,250,245 | 10/1993 | Collins et al. | 264/103 |
| 5,340,909 | 8/1994 | Doerr et al. | 528/276 |
| 5,645,782 | 7/1997 | Howell et al. | 264/103 |
| 5,662,980 | 9/1997 | Howell et al. | 428/97 |
| 5,782,935 | 7/1998 | Hirt et al. | 8/512 |
| 5,885,909 | 3/1999 | Rudisill et al. | 442/82 |
| 5,968,640 | 10/1999 | Aneja | 428/364 |
| 6,023,926 | 2/2000 | Flynn | 57/210 |
| 6,033,777 | 3/2000 | Best | 428/364 |
| 6,071,612 | 6/2000 | Roderiquez et al. | 428/364 |
| 6,109,015 | 7/1998 | Roark et al. | 57/290 |

FOREIGN PATENT DOCUMENTS

| | | |
|---|---|---|
| 1075689 | 7/1967 | (GB) . |
| 1165312 | 9/1969 | (GB) . |
| 1254826 | 11/1971 | (GB) . |
| 1408094 | 10/1975 | (GB) . |
| 52-8123 | 7/1975 | (JP) . |
| 52-8124 | 7/1975 | (JP) . |
| 57-193534 | 4/1981 | (JP) . |
| 56-200227 | 12/1981 | (JP) . |
| 58-104216 | 12/1981 | (JP) . |
| 5-71013 | 3/1993 | (JP) . |
| 8-232117 | 2/1995 | (JP) . |
| 8-311177 | 5/1995 | (JP) . |
| 9-78373 | 9/1995 | (JP) . |
| 11-93036 | 9/1997 | (JP) . |
| 11-93037 | 9/1997 | (JP) . |
| 11-93038 | 9/1997 | (JP) . |
| 11-107081 | 10/1997 | (JP) . |
| 11-172536 | 9/1998 | (JP) . |
| 11-12824 | 1/1999 | (JP) . |
| 11-107036 | 4/1999 | (JP) . |
| 11-107038 | 4/1999 | (JP) . |
| 11-107081 | 4/1999 | (JP) . |
| 11-107154 | 4/1999 | (JP) . |
| 11-93026 | 4/1999 | (JP) . |
| 11-93031 | 4/1999 | (JP) . |
| 11-93049 | 4/1999 | (JP) . |
| 11-172526 | 6/1999 | (JP) . |
| 11-181626 | 7/1999 | (JP) . |
| 11-181650 | 7/1999 | (JP) . |
| 11-189920 | 7/1999 | (JP) . |
| 11-200143 | 7/1999 | (JP) . |
| 11-200175 | 7/1999 | (JP) . |
| 11-229276 | 8/1999 | (JP) . |
| 11-100721 | 4/2000 | (JP) . |
| 1996-067992 | 12/1996 | (KR) . |
| 98/23662 | 6/1998 | (WO) . |
| 98/27168 | 6/1998 | (WO) . |
| 99/39041 | 1/1999 | (WO) . |
| 99-11709 | 3/1999 | (WO) . |
| 99-11845 | 3/1999 | (WO) . |
| WO 00/39374 | 12/1999 | (WO) . |
| 00/22210 | 4/2000 | (WO) . |
| 00/29653 | 5/2000 | (WO) . |
| 2000-26301 | 5/2000 | (WO) . |

OTHER PUBLICATIONS

U.S. Patent application No. 09/708,209, filed Aug. 11, 2000 (Docket#RD7850 non–provisional).

U.S. Patent application No. 60/165,373, filed Nov. 12, 1999 (Docket#RD7850 Provisional).

U.S. Patent application No. 09/500,340, filed Feb. 8, 2000 (Docket#RD7160).

U.S. Patent application No. 09/501,700, filed Feb. 11, 2000 (Docket#RD7590).

U.S. Patent application No. 09/502,641, filed Feb. 11, 2000 (Docket#RD7605).

U.S. Patent application No. 09/503,599, filed Feb. 11, 2000 (Docket#RD7585).

U.S. Patent application No. 09/505,789, filed Feb. 17, 2000 (Docket#CL1400).

U.S. Patent application No. 09/518,759, filed Mar. 3, 2000 (Docket#DP6535).

U.S. Patent application No. 09/795,518, filed Feb. 28, 2001 (Docket#DP6535 CIP).

U.S. Patent application No. 09/ 795,520, filed Feb. 28, 2001 (Docket#DP6535 CIP1).

U.S. Patent application No. 09/587,886, filed Jun. 6, 2000 (Docket#AD6617).

DRAW TEXTURED POLY(TRIMETHYLENE TEREPHTHALATE) YARN

PRIORITY

This is a continuation of U.S. patent application Ser. No. 09/518,732, filed Mar. 3, 2000, which is incorporated herein by reference.

FIELD OF THE INVENTION

The present invention relates to textured polyester yarn. More particularly, the invention provides a partially oriented poly(trimethylene terephthalate) feed yarn, a continuous draw-texturing process for false-twist texturing of said feed yarn and a textured poly(trimethylene terephthalate) yarn.

BACKGROUND OF THE INVENTION

The preparation of textured polyester multifilament yarns has been carried out commercially on a worldwide scale for many years. There are numerous well known texturing processes, which involve crimping, looping, coiling or crinkling continuous filamentary yarns. Such texturing processes are commonly used to impart improved properties in textile yarns such as increased stretch, luxurious bulk and improved hand. In one such process, false-twist texturing, yarn is twisted between two points, heated to a heat-setting temperature, cooled and then allowed to untwist. This process imparts the desired texture because deformation caused by the twist has been set in the yarn.

False-twist texturing of polyester yarns originally employed a pin spindle method and has been generally performed on fully oriented yarn. In more recent years, a friction false-twist method was developed for use with partially oriented yarns. False-twist texturing using the fiction method permits considerably higher processing speeds than the pin spindle method. In addition, partially oriented yarns can be drawn and textured in a continuous process thereby reducing operational costs. For these reasons, the friction false-twist method is preferable in the production of textured polyester yarns. Such processes have most commonly been carried out using conventional polyester and polyamide yarns.

More recently, attention has been turned to a wider variety of polyester yarns. In particular, more resources have been allocated to commercializing poly(trimethylene terephthalate) yarns for use in the textile industry. In the prior art, only the older and less efficient pin spindle method has been successful for texturing fully oriented poly (trimethylene terephthalate) yarns. Development of a draw-texturing process for partially oriented poly(trimethylene terephthalate) yarn has been impeded by several factors.

The first factor preventing successful commercialization of a continuous draw-texture process for poly(trimethylene terephthalate) has been the lack of a stable partially oriented yarn. After spinning, a partially oriented yarn is typically wound onto a tube, or package. The yarn packages are then stored or sold for use as a feed yarn in later processing operations such as drawing or draw-texturing. A partially oriented yarn package will not be useable in subsequent drawing or draw-texturing processes if the yarn or the package itself are damaged due to aging of the yarns or other damage caused during warehousing or transportation of the yarn package.

Partially oriented poly(ethylene terephthalate) yarns do not typically age very rapidly, and thus they remain suitable for downstream drawing or draw-texturing operations. Such partially oriented yarns are typically spun at speeds of about 3500 yards per minute ("ypm") (3200 meters per minute "mpm"). In the past, attempts to make stable partially oriented poly(trimethylene terephthalate) yarns using a spinning speed in this same range have failed. The resulting partially oriented poly(trimethylene terephthalate) yarns have been found to contract up to about 25% as they crystallize with aging over time. In extreme case, the contraction is so great that the tube is physically damaged by the contraction forces of the yarn. In more common cases, the contraction renders the partially oriented poly(trimethylene terephthalate) yarns unfit for use in drawing or draw-texturing operations. In such cases, the package becomes so tightly wound that the yarn easily breaks as it is unwound from the package.

Another factor impeding the development of a commercially viable continuous draw-texturing process in the prior art has been that the proper processing conditions have not been identified. Efforts toward draw-texturing partially oriented poly(trimethylene terephthalate) yarn via a process similar to that used for polyethylene terephthalate have resulted in poor yarn quality, such as too high or too low bulk and/or excessive broken filaments. In addition to the poor yarn quality, the processing performance has been poor due to excessive texturing breaks. Whenever texturing breaks occur, the draw-texturing process comes to a halt as the yarn must be re-strung in the draw-texturing machine. Such processing inefficiencies result in reduced throughput and increased operating cost. Minor changes in the processing conditions for the friction false-twist method have likewise been unsuccessful.

Other efforts to develop a continuous draw-texture process for poly(trimethylene terephthalate) partially oriented yarns have involved lowering the draw ratio to compensate for the twist induced draw and natural contraction upon crystallization and reducing the tensions across the texturing discs to reduce the level of twist insertion. These efforts have not been successful because they have resulted in a much higher denier in the textured yarn, a poor yarn quality, and a lower operating efficiency. To compensate for these problems, adjustments in feed yarn denier must be made to obtain the desired final denier.

There is therefore a need for a stable partially oriented poly(trimethylene terephthalate) yarn and a continuous draw-texturing process for false-twist texturing the partially oriented yarn. Moreover, the need exists for an economical method for false-twist texturing of a poly(trimethylene terephthalate) partially oriented yarn. The present invention provides such a yarn and process.

SUMMARY OF THE INVENTION

The present invention comprises a stable partially oriented yarn made from polyester polymer, wherein said polymer comprises at least 85 mole % poly(trimethylene terephthalate) wherein at least 85 mole % of repeating units consist of trimethylene units, and wherein said polymer has an intrinsic viscosity of at least 0.70 dl/g and the partially oriented yarn has an elongation to break of at least 110%.

The present invention further comprises a process for spinning a stable partially oriented yarn, comprising extruding a polyester polymer through a spinneret at a spinning speed less than 2600 mpm and a temperature between about 250° C. and 270° C., wherein said polymer comprises at least 85 mole % poly(trimethylene terephthalate) wherein at least 85 mole % of repeating units consist of trimethylene units, and wherein said polymer has an intrinsic viscosity of at least 0.70 dl/g.

The present invention further comprises a process for continuous draw-texturing a partially oriented yarn made from a polymer substantially comprising poly(trimethylene terephthalate), comprising the steps of:

(a) feeding the yarn through a heater, wherein the heater is set to a temperature between about 160° C. and 200° C.;

(b) feeding the yarn to a twist insertion device, whereby the yarn is twisted such that in a region between the twist insertion device and up to and including the heater, the yarn has a twist angle of about 46 degrees to about 52 degrees; and (c) winding the yarn on a winder.

DETAILED DESCRIPTION OF THE INVENTION

Figure 1A:
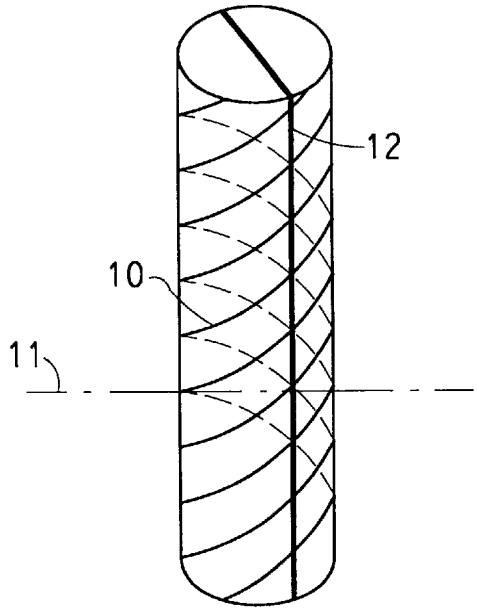
FIG. 1*a* is a schematic diagram showing the twist imparted in a twisted yarn.

A stable partially oriented poly(trimethylene terephthalate) yarn has been developed according to the present invention. Furthermore, a process for friction false-twist texturing the stable partially oriented poly (trimethylene terephthalate) yarns has also been developed. The present invention overcomes the problems heretofore experienced with partially oriented poly(trimethylene terephthalate) yarns and processes for friction false-twist texturing such yarns.

To overcome the difficulties encountered when attempting to produce a stable partially oriented poly(trimethylene terephthalate) yarn and a continuous draw-texturing process, one must understand the inherent properties of partially oriented poly(trimethylene terephthalate) yarn, as well the principles of friction false-twist texturing. Applying this understanding, a stable partially oriented poly(trimethylene terephthalate) yarn has been produced and a process for continuous draw-texturing via friction false-twist for partially oriented yarn poly(trimethylene terephthalate) has been developed.

As discussed above, when a partially oriented poly (trimethylene terephthalate) yarn crystallizes, the molecules contract. As partially oriented poly(trimethylene terephthalate) yarn becomes more oriented, total fiber shrinkage is greater upon crystallization. Thus, it has now been found that in order produce a stable partially oriented poly(trimethylene terephthalate) yarn, the yarn must have very low orientation. Orientation of a partially oriented poly(trimethylene terephthalate) yarn is inversely proportional to elongation to break ($E_B$) of the yarn. Thus, a more highly oriented yarn will have a lower $E_B$ value. Similarly, a less highly oriented yarn will have a higher $E_B$ value.

According to the present invention, a partially oriented poly(trimethylene terephthalate) yarn having an $E_B$ of at least 11 0% is a stable partially oriented poly(trimethylene terephthalate) yarn. In a preferred embodiment, the partially oriented poly(trimethylene terephthalate) yarn has an $E_B$ of at least 120%, and most preferably, the $E_B$ is at least 130%. This high elongation/low orientation can be achieved by altering the spinning process. For example, the partially oriented yarns according to the invention can be made by spinning partially oriented poly(trimethylene terephthalate) at low spinning speeds, e.g., from about 1650 mpm to 2600 mpm. The spinning temperature may range from about 250° C. to about 270° C.

Further according to the present invention, the partially oriented feed yarn is made from poly(trimethylene terephthalate) having an intrinsic viscosity ("IV") of at least 0.70 dl/g, more preferably at least 0.90 dl/g, and most preferably, at least 1.0 dl/g. The intrinsic viscosity is measured in 50/50 weight percent methylene chloride/ triflouroacetic acid following ASTM D 4603-96.

As illustrated by the examples, only partially oriented poly(trimethylene terephthalate) yarns having an $E_B$ of at least 110%, and which are made from polymer having an IV of at least 0.70 dl/g are stable and can be successfully draw-textured according to the process of the present invention.

Conventional friction false-twist texturing methods used for imparting texture to polyethylene terephthalate yarns cannot be successfully employed for the false-twist texturing of poly(trimethylene terephthalate) yarns. This is due, at least in part, to the inherent differences in the physical properties of polyethylene terephthalate and poly (trimethylene terephthalate). For example, poly (trimethylene terephthalate) yarns have higher recoverable elongation and lower tensile modulus than polyethylene terephthalate yarns. Consequently, the use of a conventional friction false-twist texturing process used for polyethylene terephthalate yarns results in excessive filament and yarn breakage, kinking and overdrawing.

It has now been found that, in order to provide an operable draw-texturing process, the final elongation of the textured poly(trimethylene terephthalate) yarn must be at least about 35%, preferably at least about 40%. If the elongation is lower than about 35%, there will be an excessive number of broken filaments and texturing breaks, and the draw-texturing process will not be commercially viable.

It has further been found that the amount of twist force applied during false-twist texturing of partially oriented poly(trimethylene terephthalate) yarns must be carefully controlled to avoid excessive yarn and filament breakage. For yarns of a given stiffness, the higher the twist force, the greater the level of twist insertion. The yarn is twisted to a level where the torque forces built up in the yarn overcome the frictional forces between the yarn surface and the texturing discs. Thus, the twisting force acts on the yarn until the yarn's stiffness resists further twisting.

Poly(trimethylene terephthalate) yarns are less stiff and therefore less resistant to twisting force than polyethylene terephthalate yarns. In other words, application of the same twisting force to a poly(trimethylene) yarn as is conventionally used for polyethylene terephthalate yarns results in a much higher level of twist insertion.

It has now been found that, in order to achieve a workable process for friction false-twisting of poly(trimethylene terephthalate) yarns, the twisting force should be adjusted such that the level of twist insertion is about 52 to 62 twists per inch, preferably about 57 twists per inch, for a 150 denier yarn. Twist angle provides a method of expressing the level of twist insertion that is independent of the yarn denier. The twist angle of a twisted multifilament yarn is the angle of filaments in relation to a line drawn perpendicular to the twisted yarn shaft as shown in FIG. 1. According to the process of the invention, the twist angle should be about 46 to about 52 degrees. If the twist angle is less than about 46 degrees, the partially oriented poly(trimethylene terephthalate) yarn will have poor processing performance and cannot be textured because of excessive texturing breaks. Additionally, the textured yarn will have poor quality because of excessive bulk. If the twist angle is more than about 52 degrees, the partially oriented poly(trimethylene terephthalate) yarn will have good processing performance, but very poor yarn quality because of low bulk and excessive broken filaments. However, by maintaining the twist angle at about 46 to 52 degrees, the processing performance results in an acceptable level of texturing breaks while producing the desired yarn quality. Table I, below, summarizes the yarn quality and processing performance experienced for a range of twist angles.

TABLE I

| Twist Angle, ° | TPI (70 Den.) | TPI (150 Den.) | Yarn Quality | Process Performance |
|---|---|---|---|---|
| 46.8 | 89.0 | 60.8 | Some tight spots, higher bulk | Higher texturing breaks |
| 49.2 | 81.8 | 55.9 | Good bulk, low broken filaments | Lower texturing breaks |
| 51.8 | 74.5 | 50.9 | Lower bulk and higher broken filaments | Least texturing breaks |

As Table I illustrates, the twist angle selected depends on the target yarn quality and processing goal. For example, in one application, it may be desirable to have increase bulk, at the expense of processing performance. On the other hand, better processing performance may be chosen over yarn quality. Another factor in determining the twist angle is the denier of the yarn. For example, when draw-texturing very fine denier partially oriented poly(trimethylene terephthalate) yarns (ie., yarns having a denier per filament of less than 1.5), the twist angle is preferably 46 to 47 degrees. For larger denier yarns, the twist angle is preferably 49 to 50 degrees. In any event, as long as the twist angle is within the range of about 46 to 52 degrees, the false-twist texturing process and yarn quality are acceptable.

Figure 1B:
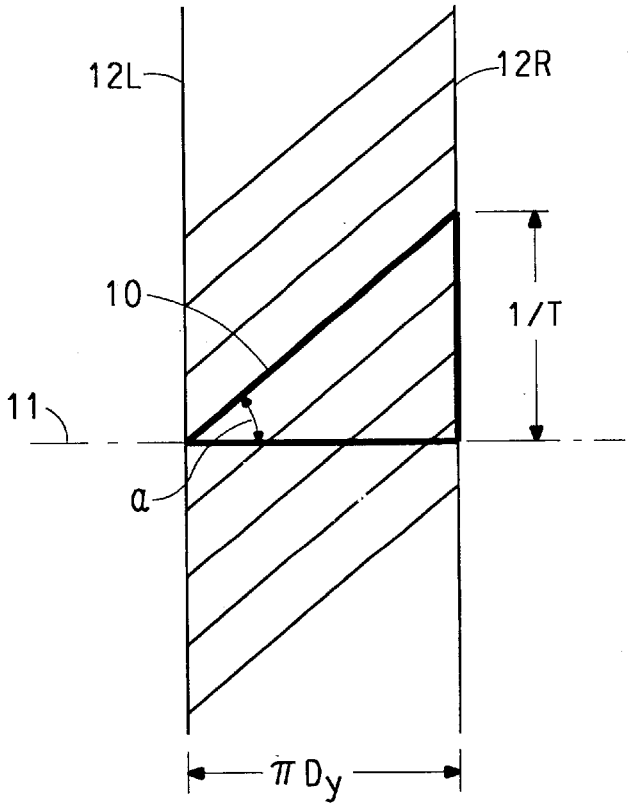
FIG. 1*b* is a schematic diagram showing the twist lines as they would look if the yarn is sliced longitudinally along one side and then flattened into a rectangular shape. The figure further shows the twist angle for a twisted yarn as defined herein.

The twist angle, $\alpha$, is the angle between twist line 10 and transverse axis 11, as shown in FIG. 1*b*. FIG. 1*a* shows a schematic view of a twisted yarn. Twist line 10 represents the twist in the yarn. FIG. 1*b* shows the yarn laid out flat if split along longitudinal line 12 (shown in FIG. 1*a*). Lines 12L and 12R represent the left and right side, respectively, of the laid out yarn. Larger angles correspond to lower levels of twist insertion. From the geometry of the twist and the properties of the yarn, as shown in FIG. 1*b*, the relationship between twist angle, yarn denier, and the number of twists per inch is given by equation I, below:

$$\mathrm{Tan}(\alpha) = \frac{1/T}{\pi \times D_y}, \tag{I}$$

where T is the number of twists per inch, and $D_y$ is the diameter of the yarn.

The diameter of a yarn can be approximated from the yarn denier, in microns ($10^{-6}$ meters), according to equation (II):

$$D_y \cong 10.2 \times \sqrt{\mathrm{Denier}} \tag{II}$$

Thus, after converting twist per inch to twist per micron, twist angle $\alpha$ can be determined according to equations III or IV, below.

$$\mathrm{Tan}(\alpha) = \frac{(2.54 \times 10^4 / T)}{\pi \times 10.2 \times \sqrt{\mathrm{Denier}}} = \frac{2.49 \times 10^3}{\pi \times T \times \sqrt{\mathrm{Denier}}} \tag{III}$$

$$\alpha = \mathrm{Tan}^{-1}\left(\frac{2.49 \times 10^3}{\pi \times T \times \sqrt{\mathrm{Denier}}}\right) \tag{IV}$$

The level of twist insertion is measured by taking a sample of the yarn from the draw-texturing machine during the false-twisting process. The sample can be anywhere from 4 to 10 inches (10 to 25 cm) in length. The sample is obtained using clamps, which are applied to the yarn somewhere between the spindle and the heater. A twist counter is then used to count the number of twists in the sample. The twist angle can then be calculated using equation IV above. The denier used in equations II though IV is the final denier of the textured yarn.

The twisting force, and consequently the level of twist insertion, can be controlled in many ways in a friction false-twist process. For example, the number of working discs can be altered and/or the surface properties of the working discs can be adjusted. If the working discs are of the ceramic variety, the material used, the surface roughness and the coefficient of friction determines the twist force applied by each disc in the false-twist texturing device. For example, a highly polished working surface on the friction disc exerts less twisting force on the yarn than would be exerted by a less polished working disc. If the discs are of the polyurethane variety, the twisting force can be reduced by increasing the hardness, and consequently, the coefficient of friction for the disc surface. Standard polyurethane discs have a Shore D hardness of about 80 to 95. The twisting force can be reduced by using polyurethane discs having a Shore D hardness of more than about 90.

Figure 2A:
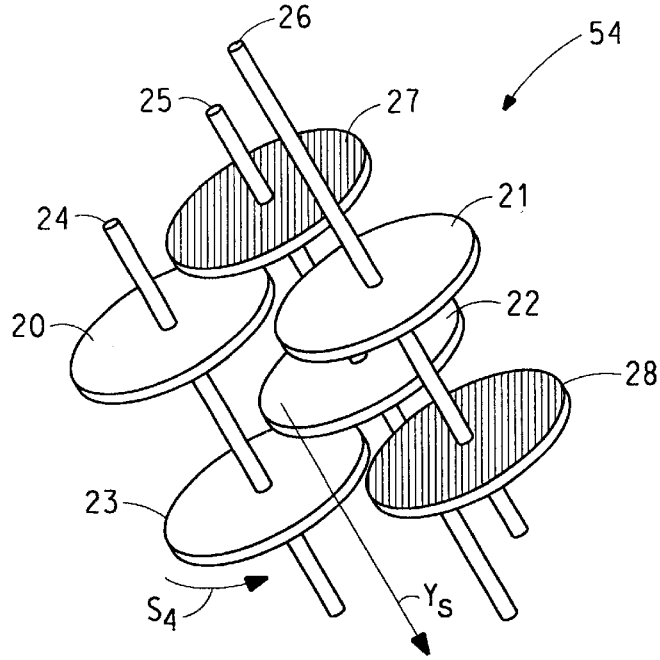
FIG. 2*a* is a diagram of a friction false-twist spindle used in one embodiment of the present invention.
Figure 2B:
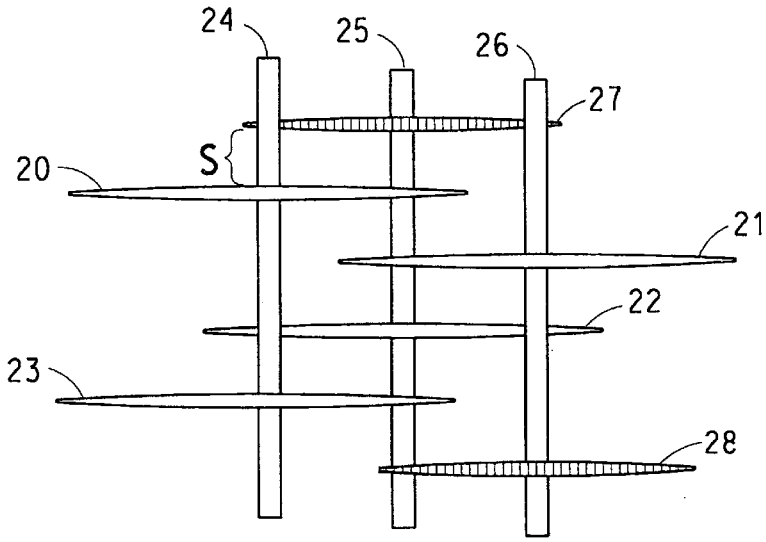
FIG. 2*b* is a schematic diagram of the friction discs of the friction false-twist spindle shown in FIG. 2*a*.
Figure 3:
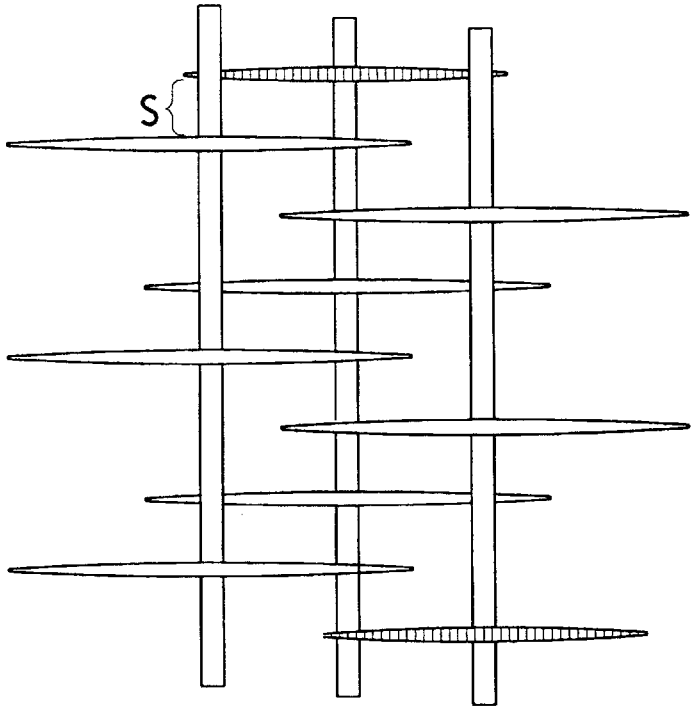
FIG. 3 is a diagram of a friction false-twist spindle used in the prior art for a polyethylene terephthalate false-twist process.

In a preferred embodiment, the false-twist texturing process for poly(trimethylene terephthalate) yarn employs only three or four working discs, as shown in FIGS. 2*a* and 2*b*. Working discs 20, 21, 22, and 23 are mounted on parallel axles 24, 25, 26. Entry guide disc 27 and exit guide disc 28 serve to guide the yarn into the false-twisting apparatus and do not impose twisting force on the yarn. In a more preferred embodiment, the spacing between discs, S, is about 0.75 to 1.0 mm, as shown in FIG. 2*a*. In contrast, a conventional process for false-twist texturing of polyethylene terephthalate yarns typically employs five to seven working discs which are spaced apart by about 0.5 mm, as shown in FIG. 3.

Further, when making textured poly(trimethylene terephthalate) yarns having a final denier per filament of 2 or higher, the desired twist angle is best achieved by using a 1/3/1 disc configuration, i.e., one entry guide disc, three working discs, and one exit guide disc. When making textured poly(trimethylene terephthalate) yarn having less than 2-denier per filament, a 1/4/1 disc configuration, as shown in FIG. 2*a*, best achieves the desired result.

Figure 4:
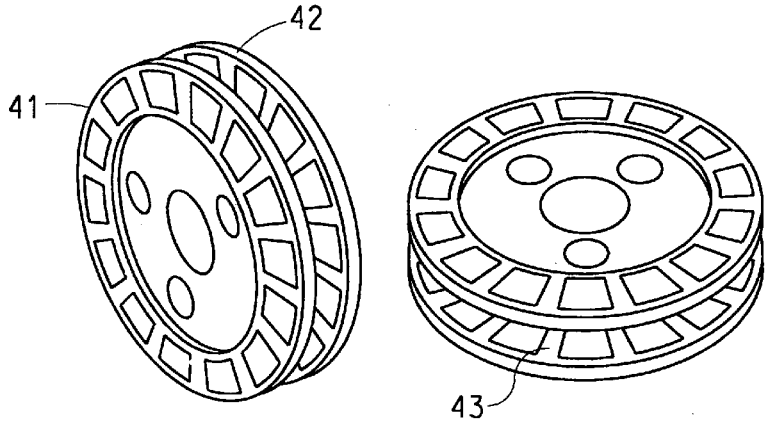
FIG. 4 is a schematic diagram of a twist stop device used in an embodiment of the present invention.

The preferred embodiment of the invention also utilizes a device to isolate the twist between the first delivery roll and the entrance to the heater. The preferred type of twist isolation device is known as a twist stop. As shown in FIG. 4, the preferred twist stop consists of two circular rims 41 and 42 spaced apart from one another and having a series of spokes or ribs 43. The yarn is woven through the spokes 43. Such twist stop devices may be obtained from textile machine suppliers such as Eldon Specialties, Inc., Graham, N.C.

Figure 5:
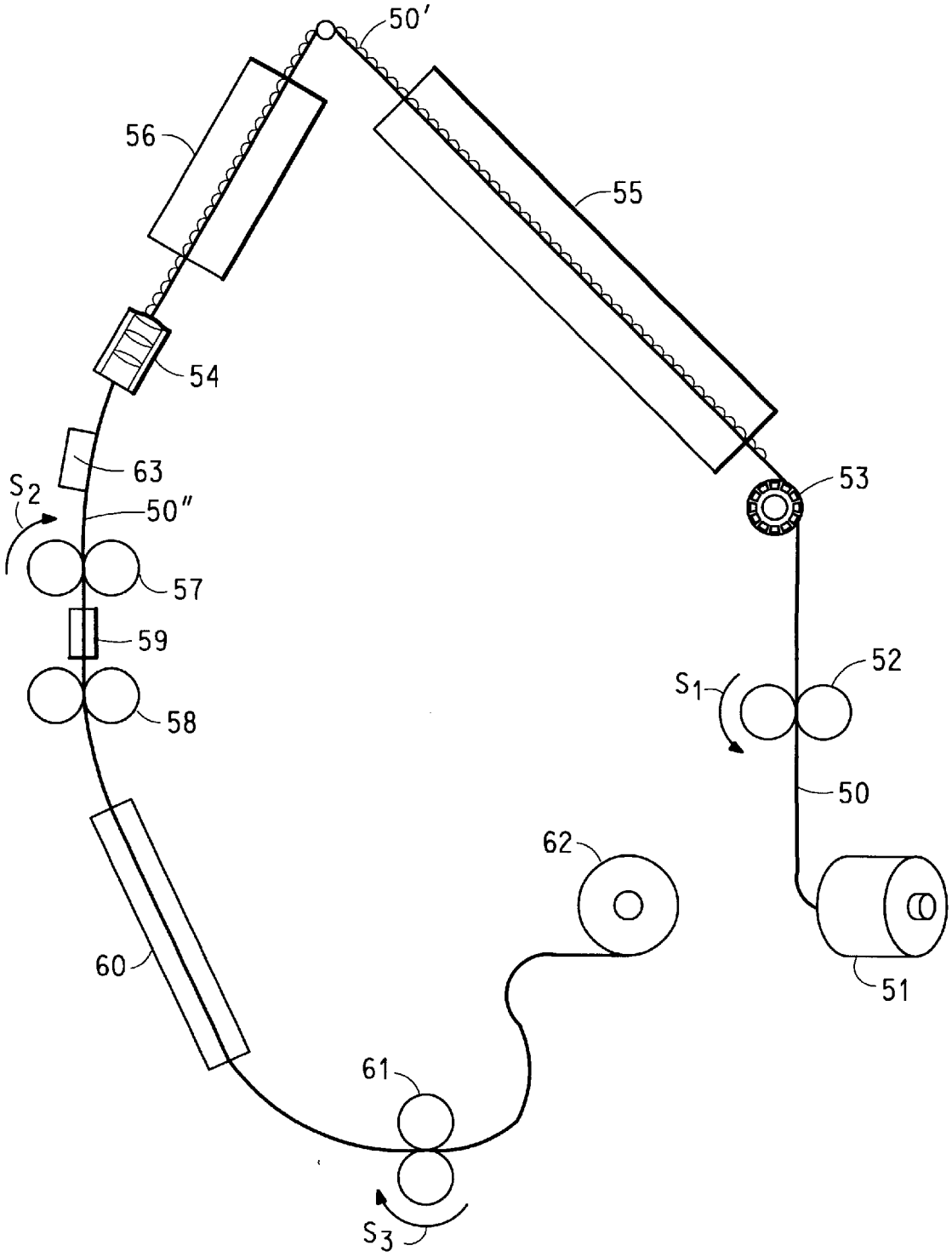
FIG. 5 is a schematic diagram of the friction false-twist process of the present invention.

FIG. 5 is a schematic diagram showing an apparatus useful in carrying out a preferred embodiment of the friction false-twist process of the invention. Partially oriented yarn 50 is fed from creel supply 51 through the first feed roll 52. From feed roll 52, the partially oriented yarn 50 is threaded through twist stop 53, as described above. As shown in FIG. 5, the yarn is twisted between twist stop 53 and twist insertion device 54. Twisted yarn 50' passes through heater 55 which is set to a heat setting temperature of about 160° C. to about 200° C., preferably about 180° C. Twisted yarn 50' is then passed through cooling plate 56 which is adjacent to heater 55, as shown in FIG. 5. As yarn 50' passes over cooling plate 56, it is cooled to a temperature substantially lower than the heat setting temperature in order to heat set the twist in the yarn. From twist insertion device 54, the yarn is fed into second roll 57 as shown in FIG. 5. The speed of second feed roll 57, $S_2$, and the speed of first feed roll 52, $S_1$, determine the draw ratio, which is defined as the ratio: $S_2/S_1$. Because the present example employs a false-twist process, the yarn loses the twist inserted by twist insertion device 54 as it exits that device. However, the yarn retains the texture imparted by the false-twist process. Drawn and textured yarn 50" passes from second feed roll 57 to third feed roll 58. Interlace jet 59, located between second feed roll 57 and third feed roll 58, is used to increase cohesion between the filaments. Second heater 60 is normally used to post heat set the yarn, but in texturing poly(trimethylene terephthalate) yarns for maximum stretch it is turned off.

Thus, yarn 50" is drawn and textured and has the desired level of cohesion between the filaments as it is fed through fourth feed roll 61 and rolled onto take-up package 62. Take-up speed is defined as the speed, $S_3$, of take-up winder 61, as shown in FIG. 5. In a preferred embodiment, twist insertion device 54 is a friction spindle comprising parallel axles and friction discs as described above.

Measurements discussed herein were made using conventional U.S. textile units, including denier. The dtex equivalents for denier are provided in parentheses after the actual measured values. Similarly, tenacity and modulus measurements were measured and reported in grams per denier ("gpd") with the equivalent dN/tex value in parentheses.

Test Methods

The physical properties of the partially oriented poly (trimethylene terephthalate) yarns reported in the following examples were measured using an Instron Corp. tensile tester, model no. 1122. More specifically, elongation to break, $E_B$, and tenacity were measured according to ASTM D-2256.

Boil Off Shrinkage ("BOS") was determined according to ASTM D 2259 as follows: a weight was suspended from a length of yarn to produce a 0.2 g/d (0.18 dN/tex) load on the yarn and measuring its length, $L_1$. The weight was then removed and the yarn was immersed in boiling water for 30 minutes. The yarn was then removed from the boiling water, centrifuged for about a minute and allowed to cool for about 5 minutes. The cooled yarn is then loaded with the same weight as before. The new length of the yarn, $L_2$, was recorded. The percent shrinkage was then calculated according to equation (V), below:

$$\text{Shrinkage}(\%) = \frac{L_1 - L_2}{L_1} \times 100 \qquad \text{(V)}$$

Dry Heat Shrinkage ("DHS") was determined according to ASTM D 2259 substantially as described above for BOS. $L_1$ was measured as described, however, instead of being immersed in boiling water, the yarn was placed in an oven at about 160° C. After about 30 minutes, the yarn was removed from the oven and allowed to cool for about 15 minutes before $L_2$ was measured. The percent shrinkage was then calculated according to equation (V), above.

The well-known Leesona Skein Shrinkage test was used to measure bulk of the textured yarns.

EXAMPLES

Example I

Polymer Preparation

Poly(trimethylene terephthalate) polymer was prepared from 1,3-propanediol and dimethylterephthalate in a two-vessel process using tetraisopropyl titanate catalyst, Tyzor® TPT (a registered trademark of E. I. du Pont de Nemours and Company, Wilmington, Del.) at 60 parts per million ("ppm") (micrograms per gram) by weight, based on finished polymer. Molten dimethylterephthalate was added to 1,3-propanediol and catalyst at 185° C. in a transesterification vessel, and the temperature was increased to 210 ° C. while methanol was removed. If titanium dioxide was desired, it was added to the process as 20% slurry in 1,3-propanediol. The resulting intermediate was transferred to a polycondensation vessel where the pressure was reduced to one millibar, and the temperature was increased to 255 ° C. When the desired melt viscosity was reached, the pressure was increased and the polymer was extruded, cooled, and cut into pellets. The pellets were solid-phase polymerized to an intrinsic viscosity of 1.04 dl/g in a tumble dryer operated at 212° C.

Example II

Partially Oriented Yarn Preparation

Yarn was spun from the poly(trimethylene terephthalate) pellets prepared in Example I using a conventional remelt single screw extrusion process and a conventional polyester fiber melt-spinning (S-wrap) process. The melt-spinning process conditions are given in Table II, below. The polymer was extruded through orifices having a shape and diameter as set forth in Table II. The spin block was maintained at a temperature such as required to give a polymer temperature as set forth in Table II. The filamentary streams leaving the spinneret were quenched with air at 21° C., collected into bundles, a spin finish was applied, and the filaments were interlaced and collected. The physical properties of the partially oriented poly(trimethylene terephthalate) yarns were measured using an Instron Corp. tensile tester, model no. 1122, and are set forth in Table III.

TABLE II

| Ex. | Cross-section | Orifice Dia. (mm) | Polymer Temp, ° C. | # of Fila-ments | Spin Finish (wt. %) | Feed Roll Speed (mpm) | Wind-ing Speed (mpm) |
|---|---|---|---|---|---|---|---|
| II-A | Round | 0.38 | 265 | 34 | 0.5 | 2286 | 2307 |
| II-B | Octa-lobal | — | 260 | 50 | 0.5 | 2103 | 2106 |
| II-C | Round | 0.38 | 255 | 34 | 0.4 | 2103 | 2119 |
| II-D | Round | 0.23 | 254 | 100 | 0.6 | 1829 | 1808 |
| II-E | Round | 0.23 | 254 | 200 | 0.6 | 1796 | 1767 |
| II-F | Round | 0.32 | 260 | 68 | 0.5 | 1920 | 1915 |

TABLE III

| Ex. | $E_B$, % | POY Denier (dtex) | Tenacity, g/d (dN/tex) | Modulus, g/d (dN/tex) | BOS, % |
|---|---|---|---|---|---|
| II-A | 131.6 | 226(251) | 2.13(1.88) | 19.0(16.8) | 53.8 |
| II-B | 130.7 | 227(252) | 2.06(1.82) | 20.7(18.3) | 56.2 |
| II-C | 130.3 | 105(117) | 2.32(2.05) | 19.6(17.3) | 52.1 |
| II-D | 128.1 | 107(119) | 2.47(2.18) | 18.6(16.4) | 52.4 |
| II-E | 137.1 | 226(251) | 2.33(2.06) | 18.0(15.9) | 53.3 |
| II-F | 127.5 | 113(125) | 2.34(2.07) | 19.2(16.9) | — |

As illustrated in Examples III and IV, below, the partially oriented poly(trimethylene terephthalate) yarns made in this example were suitable for subsequent drawing and/or draw-texturing operations. These subsequent operations were not hampered by excessive shrinking due to aging of the partially oriented poly(trimethylene terephthalate) yarns.

Example III

Single End Drawing

This example showed that partially oriented yarns produced according to the present invention are useful in subsequent drawing operations. The example further showed that the yarns are useful as flat yarns, i.e., the yarns in this example were not textured. Partially oriented yarns produced as described in Examples II-A, II-C, II-D and II-E were drawn on a Barmag draw winder, model DW48, with a godet temperature of 130° C. The draw speed, draw ratio, and physical properties of the resulting drawn yarns, as measured on an Instron tensile tester, model 1122, are given in Table IV, below. Partially oriented yarn produced as described in Example II-D was drawn with three different draw ratios, as reported in Table IV.

TABLE IV

| Ex. | Draw Speed (mpm) | Draw Ratio | Denier (dtex) | Tenacity, g/d (dN/tex) | $E_B$, % | Modulus, g/d (dN/tex) | BOS, % |
|---|---|---|---|---|---|---|---|
| III-A | 400 | 1.41 | 164 (182) | 2.89(2.55) | 59.8 | — | — |
| III-C | 420 | 1.53 | 74(82) | 2.91(2.57) | 60.0 | 13.4(11.8) | — |
| III-$D_1$ | 400 | 1.40 | 78(87) | 2.98(2.63) | 54.0 | 21.2(18.7) | 13.3 |
| III-$D_2$ | 400 | 1.50 | 73(82) | 3.21(2.83) | 42.5 | 23.4(20.7) | 13.9 |
| III-$D_3$ | 400 | 1.52 | 73(81) | 3.21(2.83) | 39.0 | 23(20.3) | 14.0 |
| III-E | 400 | 1.54 | 71(79) | 3.13(2.76) | 63.0 | 11.4(10.1) | 5.4 |

Example IV

Draw-Texturing

This example showed that partially oriented yarns produced according to the present invention are useful in subsequent draw-texturing operations. The example further showed the draw-texturing process conditions needed to successfully texture a partially oriented poly(trimethylene terephthalate) yarn using a false-twist texturing process. Using an apparatus as illustrated in FIG. 5, the partially oriented yarns prepared in Examples II-A to II-E were friction false-twist textured in accordance with the present invention. The yarns were heated to a temperature of about 180° C. as they passed through the heater and cooled to a temperature below the glass transition temperature of poly (trimethylene terephthalate) as they passed over the cooling plate.

The remaining draw-texturing process conditions and the properties of the resulting draw-textured poly(trimethylene terephthalate) yarns are set forth in Table V, below. In Table V, the draw ratio is given as ratio of the speed of the draw roll to the speed of the feed roll, $S_2/S_1$. The tension reported in Table V is as measured at tension monitoring device 63, shown in FIG. 5.

The ratio of disc speed to yarn speed reported in Table IV is determined by dividing the surface speed of the friction discs, $S_4$, by the speed, $Y_s$, of the yarn as it passes through the twist insertion device. The processing conditions and properties for commercially available polyethylene terephthalate textured yarns are provided for comparison.

TABLE V

Draw-Texturing Conditions and Textured Yarn Properties

| Example Id. | Draw Ratio[1] | Heater Temp, ° C. | Take-up Speed[2] (M/M) | Disc Config[3] | Disc to Yarn Ratio[4] | Tension[5], g/d (dN/tex) | Final Denier (dtex) | Final Tenacity, g/d (dN/tex) | Final $E_B$, % | Leesona Shrinkage |
|---|---|---|---|---|---|---|---|---|---|---|
| IV-A | 1.509 | 180 | 500 | 1/3/1 | 1.95 | 35(3l) | 162(180) | 2.88(2.54) | 43.8 | 47.7 |
| comp. A | 1.710 | 225 | 500 | 1/5/1 | 1.95 | 65(57) | 163(181) | 4.46(3.94) | 20.2 | 42.04 |
| IV-B | 1.539 | 180 | 450 | 1/3/1 | 1.95 | 32(28) | 159(177) | 2.50(2.21) | 37.1 | 31.6 |
| comp. B | 1.647 | 220 | 600 | 1/5/1 | 1.95 | 34(30) | 156(173) | 4.06(3.58) | 23.8 | 33.8 |
| IV-c | 1.539 | 180 | 500 | 1/3/1 | 1.95 | 27(24) | 72(80) | 2.90(2.56) | 46.2 | 48.9 |
| comp. C | 1.710 | 210 | 600 | 1/5/1 | 1.95 | 20(18) | 73(81) | 4.81(4.25) | 23.2 | 50.5 |
| IV-D | 1.464 | 180 | 400 | 1/4/1 | 1.95 | 27(24) | 72(80) | 2.86(2.52) | 46.2 | 16.05 |
| comp. D | 1.560 | 200 | 500 | 1/7/1 | 1.95 | 20(18) | 74(82) | 4.39(3.87) | 39.3 | 13.35 |
| IV-E | 1.495 | 180 | 400 | 1/4/1 | 2.1 | 33(29) | 151(168) | 2.80(2.47) | 39.0 | 10.25 |
| comp. E | 1.590 | 200 | 500 | 1/7/1 | 2.1 | 20(18) | 160(178) | 3.80(3.35) | 43.7 | 9.30 |
| IV-F | 1.470 | 180 | 400 | 1/4/1 | 1.95 | 28(25) | 78(87) | 3.15(2.78) | 34.9 | 30.6 |

[1] $S_2/S_1$;
[2] $S_3$;

TABLE V-continued

| Draw-Texturing Conditions and Textured Yarn Properties | | | | | | | | | | |
|---|---|---|---|---|---|---|---|---|---|---|
| Example Id. | Draw Ratio[1] | Heater Temp, ° C. | Take-up Speed[2] (M/M) | Disc Config[3] | Disc to Yarn Ratio[4] | Tension[5], g/d (dN/tex) | Final Denier (dtex) | Final Tenacity, g/d (dN/tex) | Final $E_B$, % | Leesona Shrinkage |

[3]Entry guide discs/Working discs/Exit guide discs;
[4]$S_4/Y_s$;
[5]Measured at tension monitor 63

What we claim is:

1. A draw textured yarn made by continuous draw-texturing a partially oriented feed yarn with the following steps:

(a) providing a partially oriented feed yarn made from a polyester polymer, wherein (i) said polymer comprises at least 85 mole % poly(trimethylene terephthalate) wherein at least 85 mole % of repeating units consist of trimethylene units, (ii) the polymer has an intrinsic viscosity of at least 0.70 dl/g, and (iii) the partially oriented yarn has an elongation to break of 110–137.1%;

(b) heating the partially oriented feed yarn in a heater set to a temperature between about 160° C. and 200 °C.;

(c) twisting the yarn using a twist insertion device such that in a region between the twist insertion device and up to and including the heater, the yarn has a twist angle of about 46 degrees to about 52 degrees; and (d) winding the yarn on a winder.

2. The draw textured yarn of claim 1, wherein the twist insertion device is a friction spindle.

3. The process of claim 2, wherein the friction spindle comprises at least one entry guide disc, three to five working discs, and one exit guide disc.

4. The draw textured yarn of claim 2, wherein the friction spindle comprises at least one entry guide disc, three to four working discs, and one exit guide disc.

5. The draw textured yarn of claim 2, wherein the friction spindle comprises working disc spaced apart by about 0.75 to 1.0 mm.

6. The draw textured yarn of claim 1, further comprising passing the yarn through a twist isolation device prior to heating the yarn.

7. The draw textured yarn of claim 1, wherein the partially oriented feed yarn has an elongation to break of at least 120%.

8. The draw textured yarn of claim 1, wherein the partially oriented feed yarn has an elongation to break of at least 130%.

9. The draw textured yarn of claim 1, wherein the polymer has an intrinsic viscosity of at least 0.90 dl/g.

10. The draw textured yarn of claim 1, wherein the polymer has an intrinsic viscosity of at least 1.0 dl/g.

11. The draw textured yarn of claim 1 wherein prior to heating the yarn passes through a twist isolation device and wherein the twist insertion device is a friction spindle comprising at least one entry guide disc, three to four working discs, and one exit guide disc and the working discs are spaced apart by about 0.75 to 1.0 mm.

12. The draw textured yarn of claim 11 wherein the yarn is drawn between a first feed roll located prior to the twist isolation device and a second feed roll located after the twist insertion device.

13. The draw textured yarn of claim 1 wherein the continuous draw-texturing comprises a friction false twist process sequentially comprising (1) threading the yarn through a twist stop, (2) the heating the yarn in step (b), (3) cooling the yarn to heat set the yarn, and (4) feeding the yarn to the twist insertion device; and wherein the yarn is twisted between the twist stop and a twist insertion device.

14. The draw textured yarn of claim 13 wherein the yarn is drawn by passing through a first feed roll and a second roll, and the first feed roll is located prior to the twist stop and the second roll is located after the twist insertion device.

15. The draw textured yarn of claim 14 wherein after passing the second feed roll, an interlace jet is used to increase cohesion between the filaments, and then the yarn passes a third feed roll.

16. The draw textured yarn of claim 14 wherein the yarn is not post heat set after drawing and texturing the yarn.

17. The draw textured yarn of claim 14 wherein the twist stop consists of two circular rims spaced apart from each other and having a series of spokes, and wherein the yarn is woven through the spokes.

18. The draw textured yarn of claim 13 wherein the twist insertion device is a friction spindle comprising at least one entry guide disc, three to four working discs, and one exit guide disc and the working discs are spaced apart by about 0.75 to 1.0 mn.

19. The draw textured yarn of claim 17 wherein the twist insertion device is a friction spindle comprising at least one entry guide disc, three to four working discs, and one exit guide disc and the working discs are spaced apart by about 0.75 to 1.0 mm.

* * * * *